US007438035B2

(12) United States Patent
Farah

(10) Patent No.: US 7,438,035 B2
(45) **Date of Patent: *Oct. 21, 2008**

(54) CAM DRIVE APPARATUS HAVING A MAGNETIC GEAR

(75) Inventor: Philippe S. Farah, Maisons-Laffitte (FR)

(73) Assignee: Delphi Technologies, Inc., Troy, MI (US)

( * ) Notice: Subject to any disclaimer, the term of this patent is extended or adjusted under 35 U.S.C. 154(b) by 15 days.

This patent is subject to a terminal disclaimer.

(21) Appl. No.: 11/591,099

(22) Filed: Nov. 1, 2006

(65) Prior Publication Data

US 2007/0107685 A1 May 17, 2007

(30) Foreign Application Priority Data

Nov. 16, 2005 (GB) ..... 0523329.1

(51) Int. Cl.
*F01L 1/02* (2006.01)

(52) U.S. Cl. ..... 123/90.31; 123/90.15; 123/90.27; 464/29; 464/160

(58) Field of Classification Search ..... 123/90.15, 123/90.16, 90.17, 90.18, 90.27, 90.31, 345, 123/346, 347, 348; 464/2, 29, 160
See application file for complete search history.

(56) References Cited

U.S. PATENT DOCUMENTS 6,257,186 B1 * 7/2001 Heer ..... 123/90.17
6,526,929 B2 * 3/2003 Lehmann ..... 123/90.17

* cited by examiner

*Primary Examiner*—Ching Chang
(74) *Attorney, Agent, or Firm*—Patrick M. Griffin

(57) ABSTRACT

A cam drive apparatus comprising a magnetic gear adapted to communicate rotational movement between a crankshaft and a cam shaft, wherein said magnetic gear comprises an outer member comprising a plurality of circumferentially spaced magnet means, said outer member being mounted for rotation with one of said crankshaft and camshaft, an inner member comprising a plurality of circumferentially spaced magnet means, said inner member being concentrically arranged within said outer member to define an annular gap therebetween, and an intermediate member comprising a plurality of circumferentially spaced ferromagnetic pole pieces located within said annular gap between said inner and outer members and being mounted for rotation with the other of said crankshaft and camshaft.

16 Claims, 3 Drawing Sheets

CAM DRIVE APPARATUS HAVING A MAGNETIC GEAR

TECHNICAL FIELD OF INVENTION

The present invention relates to a cam drive apparatus, particularly, but not exclusively a cam drive apparatus capable of varying the phase of a camshaft in the valve train of an automobile engine. More particularly, a cam drive apparatus having a magnetic gear adapted to communicate rotational movement between a crankshaft and a cam shaft.

BACKGROUND OF INVENTION

In automobile engines, it is necessary to provide a drive means capable of transmitting rotational drive from the engine crank shaft to the cam shaft. It is preferable that this drive means also allows the phase of the cam, that is the relationship between the rotational orientation of the crank shaft and the rotational orientation of the cam shaft, to be varied whilst the engine is running. Currently available variable cam phasers typically employ a mechanical actuator comprising a planetary gearset and worm gear drive. In order to vary the cam phase a sun gear of the planetary gearset is rotated by a DC motor; this causes the planet gears to rotate around the sun gear thereby adjusting the rotational orientation of the cam shaft. However, such systems rely on a high degree of physical contact between the gears in order to operate; this can create a large amount of friction and noise between the gears, thereby leading to inefficiency in the conversion process. This is particularly problematic under the high loads experienced in an automobile engine.

A currently available solution to this is to use an oil-based hydraulic cam phaser; however, these are susceptible to poor performance at extremes of temperature and at low engine speeds.

SUMMARY OF THE INVENTION

According to the present invention, there is provided a cam drive apparatus comprising a magnetic gear adapted to communicate rotational movement between a crankshaft and a cam shaft.

Preferably, said magnetic gear comprises an outer member comprising a plurality of circumferentially spaced magnet means, said outer member being mounted for rotation with one of said crankshaft and camshaft, an inner member comprising a plurality of circumferentially spaced magnet means, said inner member being concentrically arranged within said outer member to define an annular gap therebetween, and an intermediate member comprising a plurality of circumferentially spaced ferromagnetic pole pieces located within said annular gap between said inner and outer members and being mounted for rotation with the other of said crankshaft and camshaft.

Preferably the number of magnet means of the outer member is greater than the number of magnet means of the inner member.

With the intermediate member fixed, rotation of one of the outer or inner members (the drive member) causes a rotating magnetic field to be set up in the pole pieces of the intermediate member, causing the other of the outer or inner members (the driven member) to rotate at a different speed and in the opposite direction to the drive member. Thus, the outer member, intermediate member and inner member are respectively analogous to the ring gear, planetary gears and sun gear of a planetary gear system.

This provides a cam drive apparatus which requires no contact between the rotational drive member and the driven member and hence the cam shaft. This has many advantages including production of a minimal amount of frictional wear and noise.

The magnet means of one or both of said inner and outer rings comprise electromagnets. Alternatively, the magnet means of one or both of the inner and outer rings may comprise permanent magnets.

In one embodiment said outer member is connected to said cam shaft for rotation therewith, whereby the outer member comprises a driven member, and the intermediate member is connected to a cam sprocket or pulley for rotation therewith, said cam sprocket or pulley being driven by the crankshaft via an endless chain or belt, whereby the intermediate member comprises a drive member. In such embodiment, the inner member is connected to an actuating means for adjusting the angular relationship between the drive and driven members to adjust the cam phase as will be described below.

In an alternative embodiment the intermediate member may be connected to the camshaft to comprise the driven member and the outer member may be connected to the cam sprocket or pulley to comprise the drive member, the inner member again being connected to an actuating means for adjusting the cam phase.

In a further embodiment, the inner member may be held stationary with respect to the drive and driven members, the cam phase adjusting means being adapted to adjust the angular position of the inner member to advance or retard the cam timing.

Further features and advantages of the invention will appear more clearly on a reading of the following detail description of the preferred embodiment of the invention, which is given by way of non-limiting example only and with reference to the accompanying drawings.

BRIEF DESCRIPTION OF DRAWINGS

This invention will be further described with reference to the accompanying drawings in which.

DETAILED DESCRIPTION OF INVENTION

Figure 1:
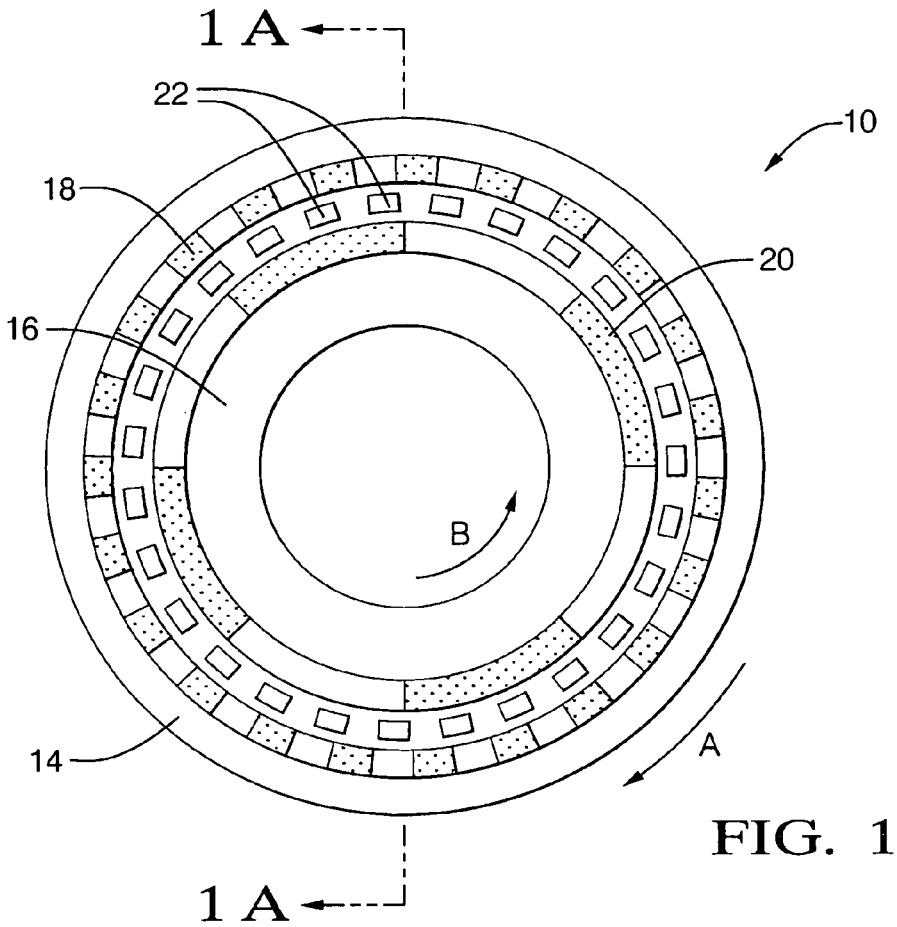
FIG. 1 is a planar cross sectional schematic view of the apparatus according to a first embodiment of the present invention.

In accordance with a preferred embodiment of this invention, referring to FIG. 1 through FIG. 3A.

The cam drive apparatus 10 comprises a magnetic gear providing a connection between the crankshaft and camshaft of an engine, the magnetic gear comprising an outer ring member 14 arranged co-axially around an inner ring member 16. A plurality of circumferentially spaced drive pole members 22 are provided in an annular gap between the driven outer ring member 14 and inner ring member 16. The pole members 22 may be provided on an intermediate ring or similar structure.

The outer ring member 14 is provided with a series of magnets 18 in the form of magnetic cells around its inner circumference. Inner ring member 16 is provided with a series of magnets 20 in the form of magnetic cells around its outer circumference. Either of the outer magnets 18 and/or inner magnets 20 may comprise electromagnets. The outer ring member 14 has a greater number of magnetic cells than the inner ring member 16. In the embodiments shown forty six magnets (arranged to provide twenty three pole-pairs) are provided on the driven outer ring member 14 and eight magnets (arranged to provide four pole-pairs) are provided on the inner member 16.

This ratio of outer magnets 18, inner magnets 20 and drive pole members 22 results in an effective gear ratio of 5.75:1, although it should be appreciated that the ratio of magnets may be selected during manufacture in order to produce a cam drive apparatus 10 with the desired gear ratio depending upon the application.

Figure 1A:
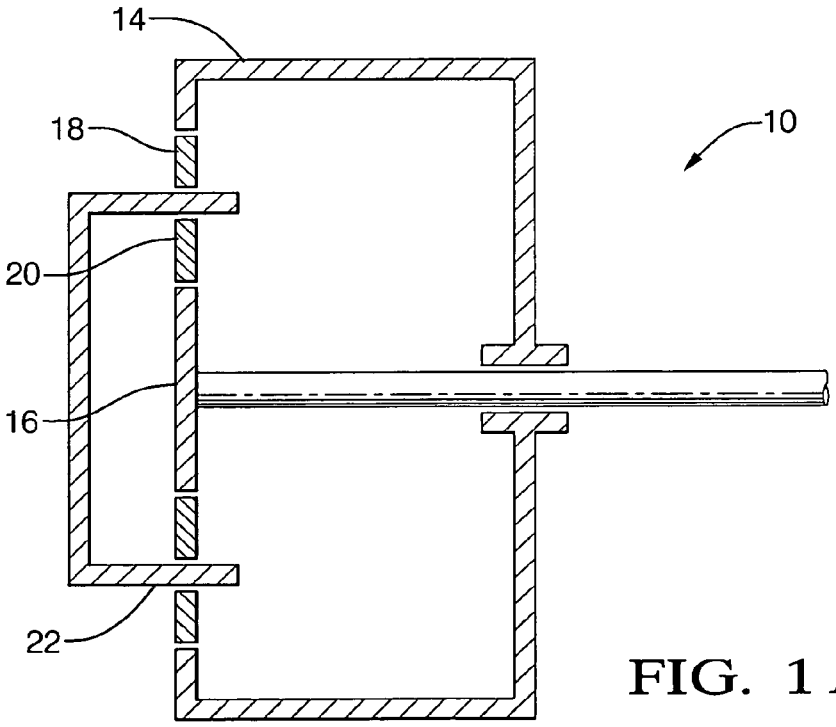
FIG. 1A is a schematic transverse view of the apparatus of FIG. 1.

According to the first embodiment of the present invention, with reference to FIG. 1 and FIG. 1A, a rotational input from the crank shaft (not shown) is connected to the drive pole members 22 by any suitable means such as a chain or belt etc. With this arrangement rotation of the vehicle's crank shaft will rotate the pole members 22 (or cells) in the annular gap between the inner ring member 16 and driven outer ring member 14.

A rotational drive output is provided by the driven outer ring member 14 and is connected to the vehicle camshaft. An electrical actuator (not shown) is connected to the inner ring member 16 and is used to control the cam phase as discussed subsequently.

In the embodiments described subsequently the drive pole members, driven outer ring member and inner ring member may respectively be regarded as mechanical equivalents of the planet carrier, ring gear and sun gear of a planetary gear mechanism.

In use, rotation of the crank shaft during engine operation causes the drive pole members 22 to rotate around the annular gap. This produces a rotating magnetic field between the driven outer magnets 18 and inner magnets 20 which causes the driven outer ring member 14 to rotate in a first direction, indicated by arrow A in FIG. 1, and the inner ring member 16 to rotate in the opposite direction, indicated by arrow B in FIG. 1. The direction of rotation of the three different members will be determined according to the respective torque on each said member.

Phase adjustment is provided using the electrical actuator (or similar device) to apply a brake torque to the inner ring member 16. This brake torque may be applied continuously whilst the engine is running and is controlled by the Engine Management System in order to compensate for frictional torque produced by the cam shaft. If it is desired to advance the phase, a higher brake torque is applied to the inner ring member 16. This changes the magnetic field pattern between the inner ring member 16 and driven outer ring member 14 such that the driven outer ring member 14 is accelerated relative to the inner ring member 16. This acceleration results in the desired phase advance. In contrast, if it is desired to retard the phase, a reduced brake torque is applied to the inner ring member 16. This decelerates the driven outer ring member 14 relative to the inner ring member 16 thereby resulting in the desired phase retardation. Depending upon the speed and extent of phase shift required, rather than simply reducing the brake torque it may be necessary to provide positive torque in the opposite direction in order to arrive at the desired phase retardation.

Figure 2:
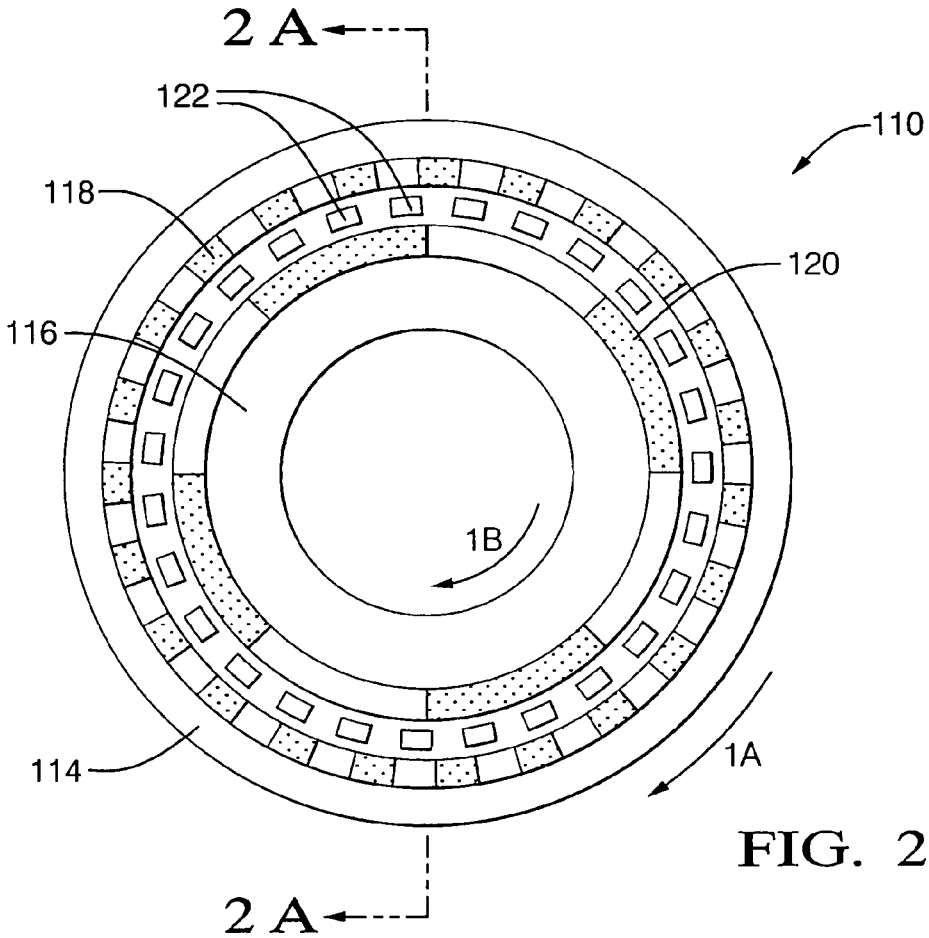
FIG. 2 is a planar cross sectional schematic view of the apparatus according to a second embodiment of the present invention.
Figure 2A:
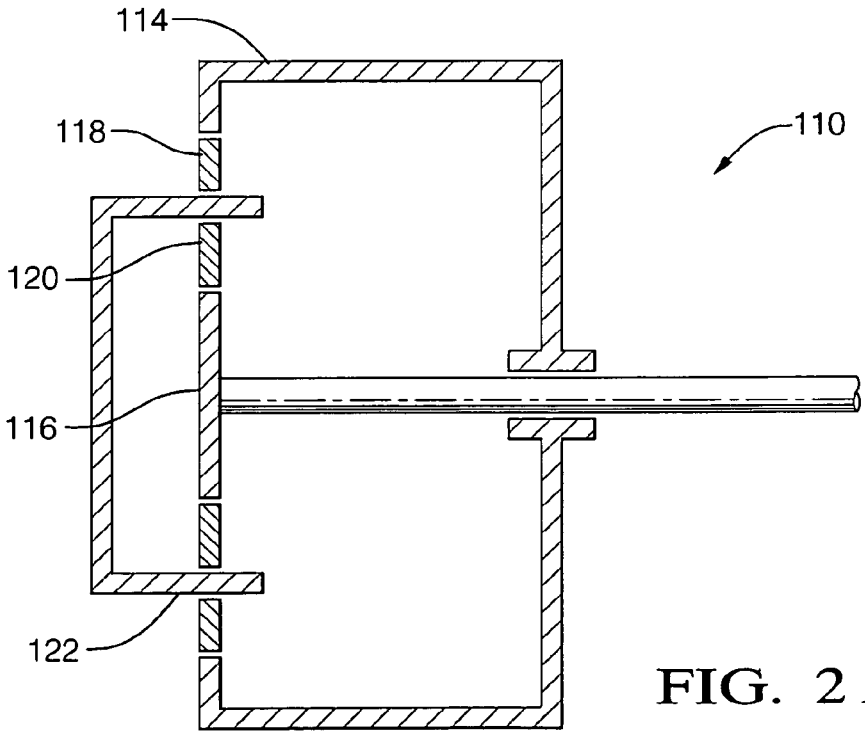
FIG. 2A is a schematic transverse view of the apparatus of FIG. 2.

With reference to FIG. 2 and FIG. 2A, a second embodiment of the present invention will now be described. In this embodiment, a number of features are similar to those previously described in relation to the first embodiment and will therefore not be described any further. However, the features of the second embodiment are connected to different components in order to provide a different mode of operation as described subsequently.

A rotational drive input from the crank shaft (not shown) is connected to the outer ring gear 114 by any suitable means such as a chain or belt etc. The cam shaft of the vehicle is connected to the driven pole members 122 (this is the opposite of the arrangement in the first embodiment). An electrical actuator (not shown) is connected to the inner ring member 116 and is used to control the cam phase as discussed subsequently.

With this arrangement, rotation of the vehicle's crank shaft will drive the outer ring member 114 which will cause the driven pole members 122 to rotate in the annular gap between the inner ring member 116 and outer drive ring member 114.

In use, rotation of the crank shaft during engine operation causes the outer drive ring member 114 to rotate in a direction indicated by arrow 1A in FIG. 2. This produces magnetic flux between the outer magnets 118 and inner magnets 120 which causes the inner ring member 116 to rotate in a direction indicated by 1B in FIG. 2, this being the same direction as the direction of rotation of outer drive ring member 114. This action also causes the driven pole members 122 to rotate in a direction indicated by arrow 1C in FIG. 2. This direction again being the same as the direction of rotation of the inner and outer driven ring members.

The cam phase is controlled using an electrical actuator (or similar device) to apply a motoring or drive torque to the inner ring member 116. This motoring torque may be applied continuously whilst the engine is running and is controlled by the Engine Management System in order to accommodate frictional torque produced by the cam shaft.

In contrast to the first embodiment if it is desired to advance the cam phase, an increased motoring torque is applied to the inner ring member 116 to accelerate the inner ring member 116. This changes the magnetic field pattern between the inner ring member 116 and outer drive ring member 114 such that driven pole members 122 are accelerated relative to the outer drive ring member 114. This acceleration results in the desired phase advance. If it is desired to retard the phase, a reduced motoring (or possibly braking) torque is applied to the inner ring member 116. This decelerates the driven pole members 122 relative to the outer drive ring member 114 thereby resulting in the desired phase retardation.

It should be noted that in the arrangement provided by both the first and the second embodiments of the present invention the gear ratio between the pole members 22 of the first embodiment or the outer ring member 114 of the second embodiment and the crank shaft shall be maintained at 2:1 in order to ensure that the overall ratio between the crank shaft and the cam shaft is substantially maintained at 2:1. In other words, the pole members 22 or outer ring member 114 may be rotated at any reasonable speed as long as appropriate control is applied by the Engine Management System to ensure that that the output from the cam drive apparatus 110 is maintained.

Figure 3:
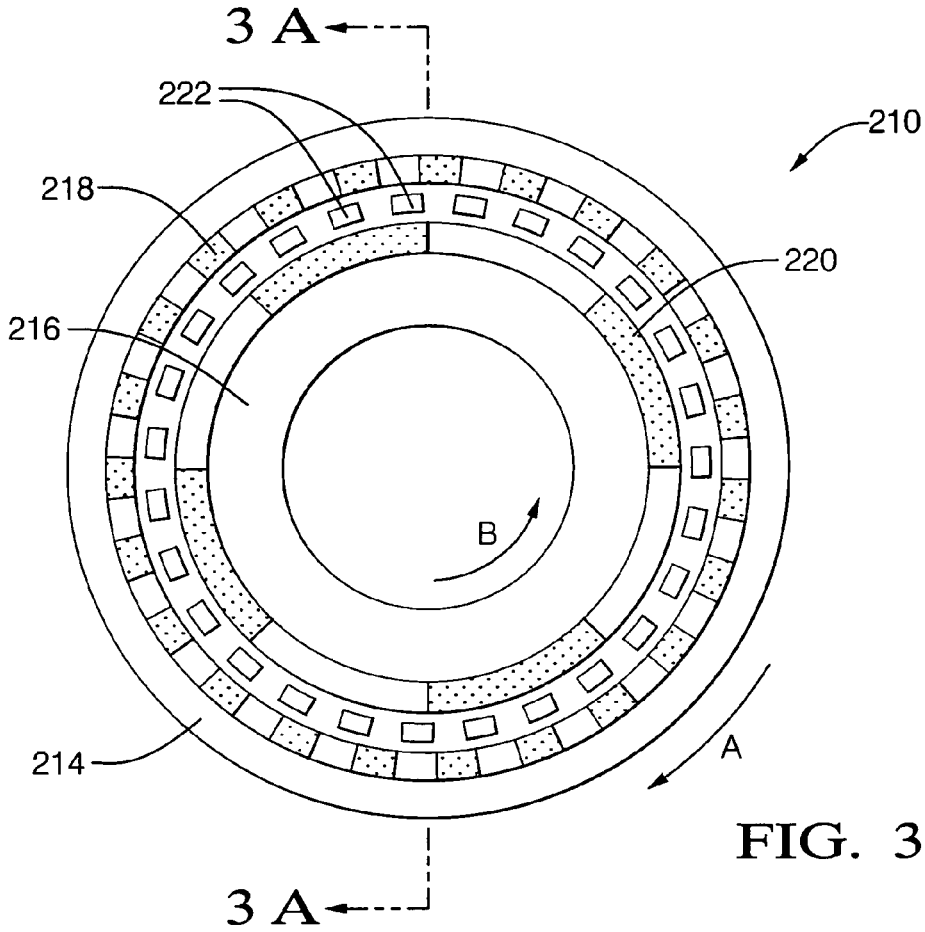
FIG. 3 is a planar cross sectional schematic view of the apparatus according to a third embodiment of the present invention.
Figure 3A:
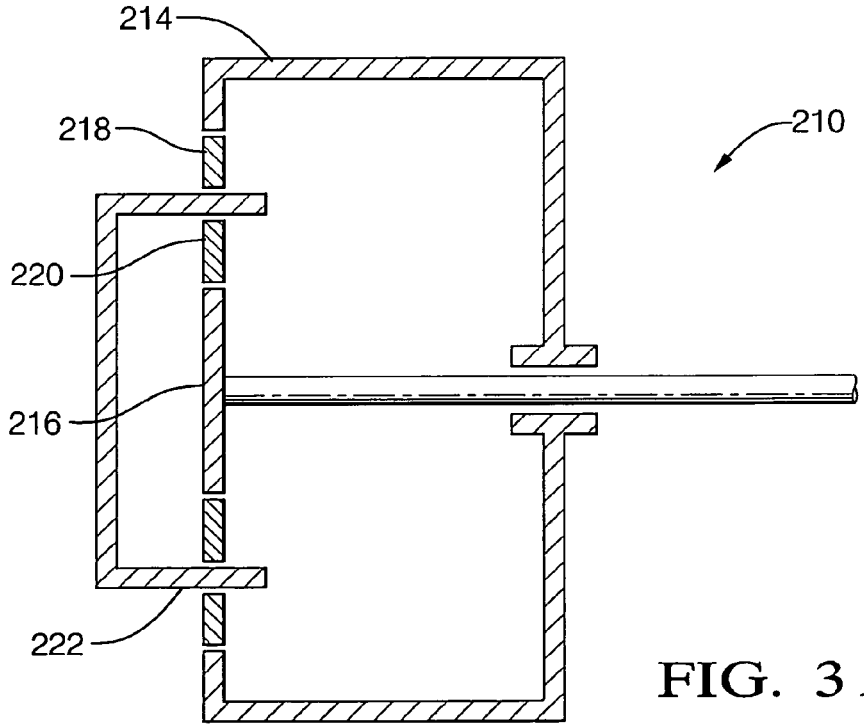
FIG. 3A is a schematic transverse view of the apparatus of FIG. 3.

With reference to FIG. 3 and FIG. 3A, a third embodiment of the present invention will now be described. In this embodiment, a number of features are similar to those previously described in relation to the previous embodiments and will therefore not be described any further. However, the features of the second embodiment are connected to different components in order to provide a different mode of operation as described subsequently.

A drive input from the crank shaft (not shown) is connected to the drive pole members 222 (which may be provided on a ring or similar structure) by any suitable means such as a chain or belt etc.

A rotational output is provided by the driven outer ring member 214 and is connected to the vehicle camshaft. An electrical actuator (not shown) is connected to the inner ring member 216 and is used to control the cam phase as discussed subsequently. In this embodiment, the inner ring member 216 is held substantially stationary whilst the engine is operating in a normal (neither advanced nor retarded) phase.

The inner ring is connected to an actuator such as a DC motor provided with a worm gear (not shown).

In use, rotation of the crank shaft during engine operation causes the drive pole members 222 to rotate around the annular gap. This produces magnetic flux between the outer magnets 218 and inner magnets 220 which causes the driven outer ring member 214 to rotate.

The cam phase is controlled using the DC motor and worm gear to selectively rotate the inner "stationary" ring member 216. In this regard, if it is desired to advance the phase, the inner ring member is rotated in the opposite direction of rotation as that of the pole members 222. This changes the magnetic field pattern between the inner ring member 216 and driven outer ring member 214 such that driven outer ring member 214 is accelerated relative to the inner ring member 216. This acceleration caused results in the desired phase advance. In contrast, if it is desired to retard the phase, the inner ring member 216 is rotated in the same direction. This decelerates the driven outer ring member 214 relative to the inner ring member 216 thereby resulting in the desired phase retardation.

Modifications and improvements may be made to the foregoing without departing from the scope of the invention, for example:

In the third embodiment of the apparatus it would be possible to swap the drive and driven members such that the drive member is provided by the outer ring member 214 and the driven member is provided by the pole members 222. Phase advance will then be obtained through rotation of the inner ring member 216 in the same direction with respect to the direction of rotation of the pole members 222. Vice-versa, phase retard will be achieved by rotation of the inner ring member 216 in the opposite direction as that of the inner ring member 216.

While this invention has been described in terms of the preferred embodiments thereof, it is not intended to be so limited, but rather only to the extent set forth in the claims that follow.

I claim:

1. A cam drive apparatus comprising a magnetic gear adapted to communicate rotational movement between a crankshaft and a camshaft, wherein said magnetic gear comprises an outer member comprising a plurality of circumferentially spaced magnet means, said outer member being mounted for rotation with one of said crankshaft and camshaft, an inner member comprising a plurality of circumferentially spaced magnet means, said inner member being concentrically arranged within said outer member to define an annular gap therebetween, and an intermediate member comprising a plurality of circumferentially spaced ferromagnetic pole pieces located within said annular gap between said inner and outer members and being mounted for rotation with the other of said crankshaft and camshaft.

2. A cam drive apparatus comprising a magnetic gear adapted to communicate rotational movement between a crankshaft and a camshaft;

wherein said magnetic gear comprises an outer member comprising a plurality of circumferentially spaced magnet means, said outer member being mounted for rotation with one of said crankshaft and camshaft, an inner member comprising a plurality of circumferentially spaced magnet means, said inner member being concentrically arranged within said outer member to define an annular gap therebetween, and an intermediate member comprising a plurality of circumferentially spaced ferromagnetic pole pieces located within said annular gap between said inner and outer members and being mounted for rotation with the other of said crankshaft and camshaft; wherein the number of magnet means of the outer member is greater than the number of magnet means of the inner member.

3. A cam drive apparatus as in claim 2, wherein the magnet means of at least one of said inner and outer members comprises electromagnets.

4. A cam drive apparatus as in claim 2, wherein the magnet means of at least one of said inner and outer members comprises permanent magnets.

5. A cam drive apparatus as in claim 2, wherein said outer member is connected to said camshaft for rotation therewith, whereby the outer member comprises a driven member, and the intermediate member is connected to means for rotation therewith, said means for rotation being driven by said crankshaft, whereby the intermediate member comprises a drive member, the inner member being connected to an actuating means for adjusting the angular relationship between the drive and driven members to adjust the cam phase.

6. A cam drive apparatus as in claim 5, wherein the inner member is held stationary with respect to the drive and driven members, and further includes a cam phase adjusting means being adapted to adjust the angular position of the inner member to adjust the cam timing.

7. A cam drive apparatus as in claim 5, wherein the inner member is rotatably driven by a drive means having an actuating means, the velocity of the drive means being controlled by the actuating means to adjust the cam timing.

8. A cam drive apparatus as claim 2, wherein the intermediate member is connected to the camshaft to comprise a driven member and the outer member is connected to means for rotation therewith to comprise a drive member, the inner member being connected to an actuating means for adjusting the cam phase.

9. A cam drive apparatus as in claim 8, wherein the inner member is held stationary with respect to the drive and driven members, and further includes a cam phase adjusting means being adapted to adjust the angular position of the inner member to adjust the cam timing.

10. A cam drive apparatus as in claim 8, wherein the inner member is rotatably driven by a drive means having the actuating means, the velocity of the drive means being controlled by the actuating means to adjust the cam timing.

11. A cam drive apparatus comprising a magnetic gear adapted to communicate rotational movement between a crankshaft and a camshaft;

wherein said magnetic gear comprises an outer member comprising a plurality of circumferentially spaced magnet means, said outer member being mounted for rotation with one of said crankshaft and camshaft, an inner member comprising a plurality of circumferentially spaced magnet means, said inner member being concentrically arranged within said outer member to define an annular gap therebetween, and an intermediate member comprising a plurality of circumferentially spaced ferromagnetic pole pieces located within said annular gap between said inner and outer members and being mounted for rotation with the other of said crankshaft and camshaft; wherein said outer member is connected to said camshaft for rotation therewith, whereby the outer member comprises a driven member, and the intermediate member is connected to means for rotation therewith, said means for rotation being driven by said crankshaft, whereby the intermediate member comprises a drive member, the inner member being connected to an actuating means for adjusting the angular relationship between the drive and driven members to adjust the cam phase.

12. A cam drive apparatus as in claim 11, wherein the inner member is held stationary with respect to the drive and driven members, and further includes a cam phase adjusting means being adapted to adjust the angular position of the inner member to adjust the cam timing.

13. A cam drive apparatus as in claim 11, wherein the inner member is rotatably driven by a drive means having an actuating means, the velocity of the drive means being controlled by the actuating means to adjust the cam timing.

14. A cam drive apparatus comprising a magnetic gear adapted to communicate rotational movement between a crankshaft and a camshaft, wherein said magnetic gear comprises an outer member comprising a plurality of circumferentially spaced magnet means, said outer member being mounted for rotation with one of said crankshaft and camshaft, an inner member comprising a plurality of circumferentially spaced magnet means, said inner member being concentrically arranged within said outer member to define an annular gap therebetween, and an intermediate member comprising a plurality of circumferentially spaced ferromagnetic pole pieces located within said annular gap between said inner and outer members and being mounted for rotation with the other of said crankshaft and camshaft, wherein the intermediate member is connected to the camshaft to comprise a driven member and the outer member is connected to means for rotation therewith to comprise a drive member, the inner member being connected to an actuating means for adjusting the cam phase.

15. A cam drive apparatus as in claim 14, wherein the inner member is held stationary with respect to the drive and driven members, and further includes a cam phase adjusting means being adapted to adjust the angular position of the inner member to adjust the cam timing.

16. A cam drive apparatus as in claim 14, wherein the inner member is rotatably driven by a drive means having the actuating means, the velocity of the drive means being controlled by the actuating means to adjust the cam timing.

* * * * *